US007882567B2

(12) United States Patent
Nascimento et al.

(10) Patent No.: US 7,882,567 B2
(45) Date of Patent: Feb. 8, 2011

(54) GLOVE WITH STRAPPING SYSTEM

(75) Inventors: Christopher Nascimento, Beaverton, OR (US); Barry Plocher, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 641 days.

(21) Appl. No.: 11/831,157

(22) Filed: Jul. 31, 2007

(65) Prior Publication Data

US 2009/0031465 A1 Feb. 5, 2009

(51) Int. Cl.
*A41D 13/08* (2006.01)
*A41D 19/00* (2006.01)
*A63B 71/14* (2006.01)

(52) U.S. Cl. ..... 2/19; 2/161.1

(58) Field of Classification Search ..... 2/16, 2/19, 20, 159, 161.1, 166; D29/123; D21/780
See application file for complete search history.

(56) References Cited

U.S. PATENT DOCUMENTS 2,778,023 A * 1/1957 Tompkins ..... 2/19
4,665,561 A * 5/1987 Aoki ..... 2/19
5,448,775 A 9/1995 Yamada et al.
5,457,819 A * 10/1995 Aoki ..... 2/19
D376,675 S 12/1996 Yamada et al.
5,878,436 A * 3/1999 Jones ..... 2/19
6,286,148 B1 * 9/2001 Meyer ..... 2/161.1
6,289,516 B1 9/2001 Motooka et al.
6,347,402 B1 * 2/2002 Aoki ..... 2/19
6,487,724 B1 * 12/2002 Aoki ..... 2/19
6,516,470 B1 * 2/2003 Aoki ..... 2/19
6,536,046 B1 3/2003 Gilligan
7,278,170 B2 * 10/2007 Anderson ..... 2/19

FOREIGN PATENT DOCUMENTS

JP 10052521 2/1998
JP 10211310 8/1998

* cited by examiner

*Primary Examiner*—Gary L Welch
*Assistant Examiner*—Amber R Anderson
(74) *Attorney, Agent, or Firm*—Plumsea Law Group, LLC

(57) ABSTRACT

A baseball or softball glove includes a strap to provide a compressive force across the fingers of a hand inserted into the glove. The compressive force facilitates the snapping the glove to catch and secure a ball. Additionally, the ring finger and the pinky finger may be inserted into the same finger stall of the glove to compensate for the weakness of the ring finger in making the snapping motion. The glove is still given the appearance of providing a separate finger stall for each finger. A guide wall is placed across the entrance to the unused finger stall to maneuver the ring finger into the pinky stall.

20 Claims, 7 Drawing Sheets

GLOVE WITH STRAPPING SYSTEM

BACKGROUND OF THE INVENTION

1. Field of the Invention

The present invention relates generally to protective sporting equipment. More particularly, the present invention relates to a baseball or softball glove that includes features to facilitate the closing of the glove around a ball.

2. Description of Related Art

Gloves are traditionally worn to protect the hands and to improve gripping ability. Depending on the application, gloves may insulate the hands from temperature extremes, they may protect against harsh or hazardous environments, and they may protect the hands mechanically by diffusing or absorbing applied forces that would otherwise cause damage.

Protective gloves are particularly common in athletics. Most athletic gloves seek to increase gripping ability and to diffuse or absorb applied forces without interfering with the hand range of motion that is necessary for athletic tasks. Some athletic gloves seek to provide adequate hand range of motion while preventing potentially damaging movements of the hand.

The use of protective gloves is especially common in baseball or softball, where the hard ball must be caught at relatively high speeds. To catch a baseball or softball using a glove, the ball impacts the palm side of the glove, and then the hand wearing the glove closes around the ball. This closing of the glove is sometimes referred to as "snapping" the glove. Baseball gloves or mitts are typically made from leather or similarly stiff materials, making snapping the glove relatively difficult until the glove is broken in by repeatedly creasing the palm portion of the glove. This problem is especially pronounced in young or inexperienced players who lack sufficient hand strength to open and close the glove. Such players may need assistance in using the glove even once the glove has been broken in.

Breaking in a glove so that it snaps easily occurs over time with regular use of the glove. However, in order to be able to more effectively use a glove sooner, players often artificially break in a glove. Artificially breaking in a glove typically includes the application of oils or other leather-softening materials, then mechanically deforming the leather of the glove. One such method involves saturating the glove with leather oil, tying the glove closed around a baseball, then placing the glove and ball underneath the mattress of the player's bed to deform the glove around the ball. Such breaking in activities can take considerable time and effort and may ultimately reduce the usable life of the glove if care is not taken when deforming the leather.

Some gloves have been developed to increase the flexibility of the glove, even when new. For example, U.S. Pat. No. 5,448,775 describes a glove having a palm notch and slits to increase the flexibility of the glove. The '775 patent removes a portion of material from the heel area of the palm of the glove to decrease the overall stiffness of the palm of the glove. Additionally, slits are formed in the upper part of the pocket material. These slits decrease the stiffness of the pocket to allow the user to more easily bend the glove with one hand. The gloves in the prior art rely upon such scoring or removal of material to decrease the overall stiffness of the glove in order to facilitate the opening and closing of the glove. No known gloves mechanically or orthotically assist the hand in performing the opening and closing motions to catch a ball.

Therefore, there exists a need in the art for a glove enhances the ability of the hand to manipulate the glove.

SUMMARY OF THE INVENTION

In a first aspect, the invention provides a baseball or softball glove comprising a palm portion, a thumb stall extending from the palm portion, a first finger stall extending from the palm portion and spaced apart from the thumb stall, and a compression strap removably attachable to an outer surface of a rear face of the palm portion to provide a compressive force to at least one finger of a hand inserted into the glove.

In another aspect, a second finger stall extends from the palm portion; and the second finger stall is sized and dimensioned to receive at least two fingers.

In another aspect, the second finger stall has an outward appearance of two separate finger stalls.

In another aspect. the second finger stall has a guide wall formed near an entrance to the finger stall, the guide wall positioned to direct the two fingers into a portion of the second finger stall.

In another aspect, the portion of the second finger stall is at or near the edge of the glove.

In another aspect, a third finger stall extends away from the palm portion between the first finger stall and the second finger stall.

In another aspect, a portion of material is attached to the thumb stall and the first finger stall to form a pocket between the thumb stall and the first finger stall.

In another aspect, the pocket includes a woven portion.

In another aspect, a first end of the compression strap is fixedly attached to the glove and a second end of the compression strap is removably attached to the outer surface of the rear face of the palm portion.

In another aspect, the first end of the compression strap is sewn to the glove.

In another aspect, a portion of material is attached to the thumb stall and the first finger stall to form a pocket between the thumb stall and the first finger stall, and the first end of the compression strap is fixedly attached to the glove near the pocket.

In another aspect, the first end of the compression strap is fixedly attached to an inner surface of the glove and the second end of the compression strap is threaded through an aperture formed in the rear face of the glove so that the second end of the compression strap may be attached to an outer surface of the rear face of the glove.

In another aspect, a ring is attached to the glove, the ring positioned within the aperture and the compression strap being threaded through the ring.

In another aspect, the ring is made of a rigid material.

In another aspect, a first portion of a securing mechanism is fixedly attached to the second end of the compression strap and a second portion of the securing mechanism is fixedly attached to an outer surface of the rear face of the glove.

In another aspect, the securing mechanism comprising a hook-and-loop system.

In another aspect, the invention provides a baseball or softball glove comprising a palm portion, a first finger stall extending from the palm portion, the first finger stall sized and dimensioned to receive at least two fingers, and a compression strap removably attachable to an outer surface of a rear face of the palm portion to provide a compressive force to a hand inserted into the glove.

In another aspect, the compressive force is applied to the main knuckles of the hand.

In another aspect, a thumb stall extends from the palm portion, a second finger stall extends from the palm portion and spaced apart from the thumb stall, and a portion of material is attached to the thumb stall and the first finger stall to form a pocket between the thumb stall and the first finger stall.

In another aspect, the invention provides a method for catching a ball comprising the steps of:

(i) providing a glove having a strapping system capable of providing a compressive force across the knuckles of a hand inserted into the glove;

(ii) inserting a hand into the glove so that a thumb is positioned within a thumb stall and at least one finger is positioned within a finger stall;

(iii) applying a compressive force across the knuckles of the hand by adjusting a tension of the strapping system; and (iv) bringing the finger stall and the thumb stall toward each other to capture the ball.

In another aspect, the compressive force inhibits movement of the hand and the at least one finger within and with respect to the glove.

In another aspect, the glove is configured so that at least two fingers are positioned within a single finger stall.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
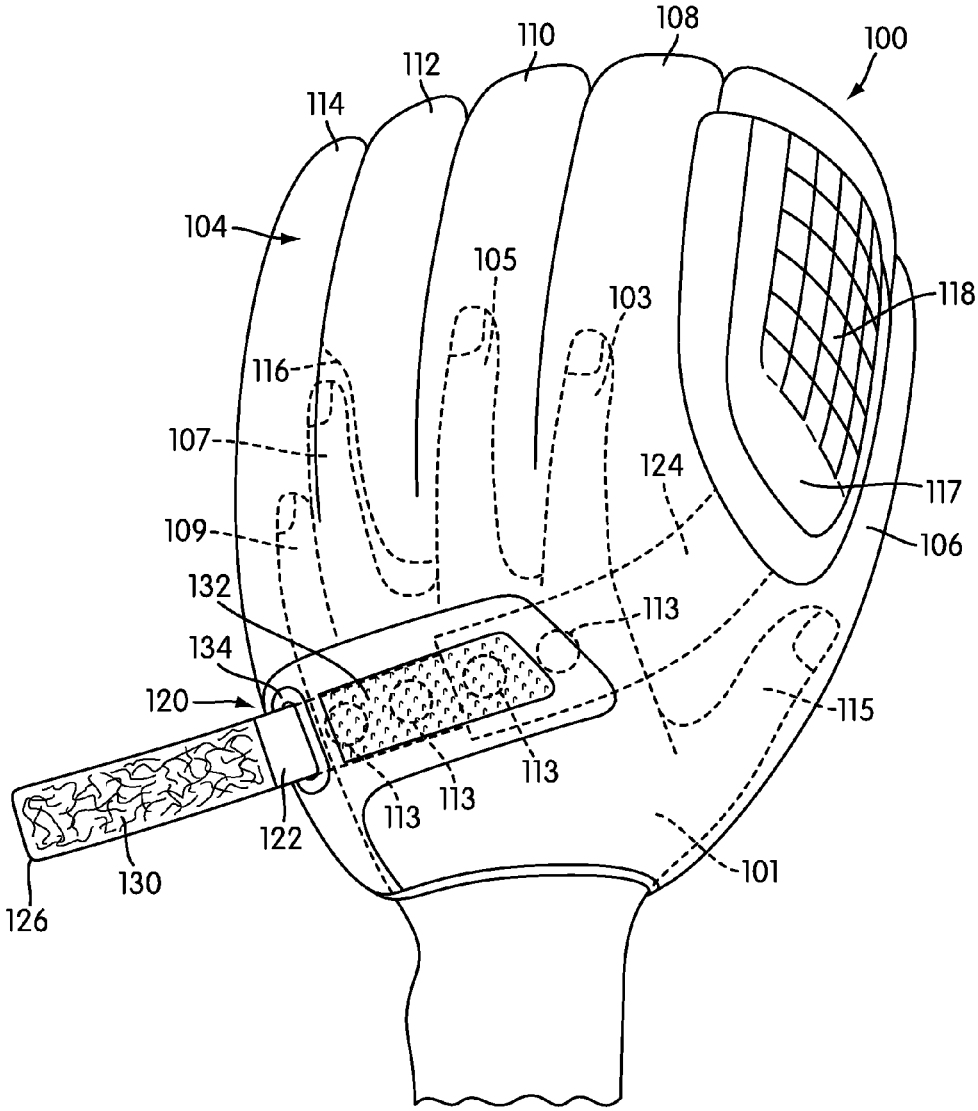
FIG. 1 is a schematic rear view of a hand in a glove according to the present invention with the strapping system in an open position.
Figure 2:
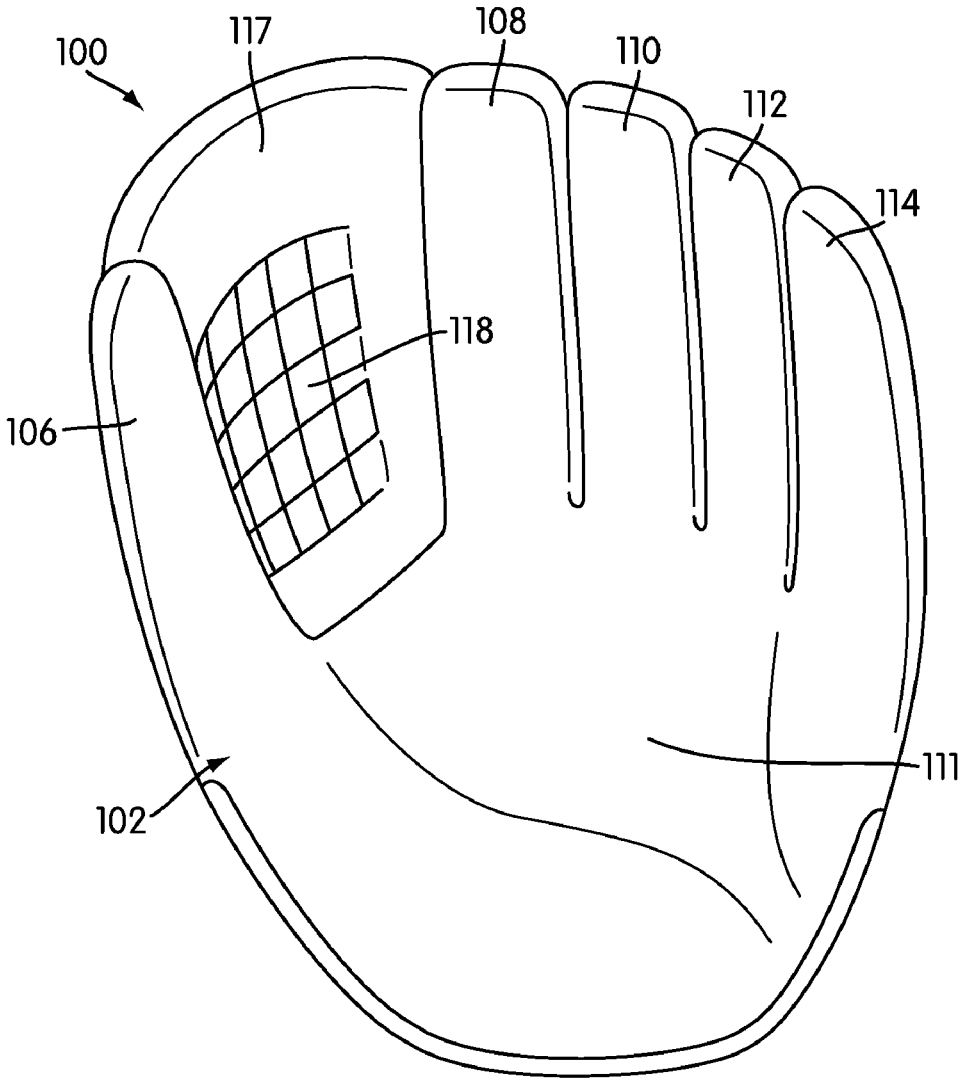
FIG. 2 is a schematic front view of the glove shown in FIG. 1.

FIG. 1 is a plan view showing a rear face 104 of a glove 100 having a strapping system 120 and a finger-positioning guide wall 116 that enhances the ability of a user to close or snap glove 100 around a ball. Although shown on a left hand 101, glove 100 may alternatively be used on a right hand, if a mirror-image glove of glove 100 is provided. FIG. 2 shows a front face 102 of glove 100. Rear face 104 and front face 102 are preferably each made from a single panel of leather or leather-like material. Rear face 104 is attached to front face 102 to form an interior pocket configured to receive a hand 101 as shown in FIG. 1. Rear face 104 may be attached to front face 102 by any method known in the art, such as with stitches, an adhesive, or the like.

Figure 3:
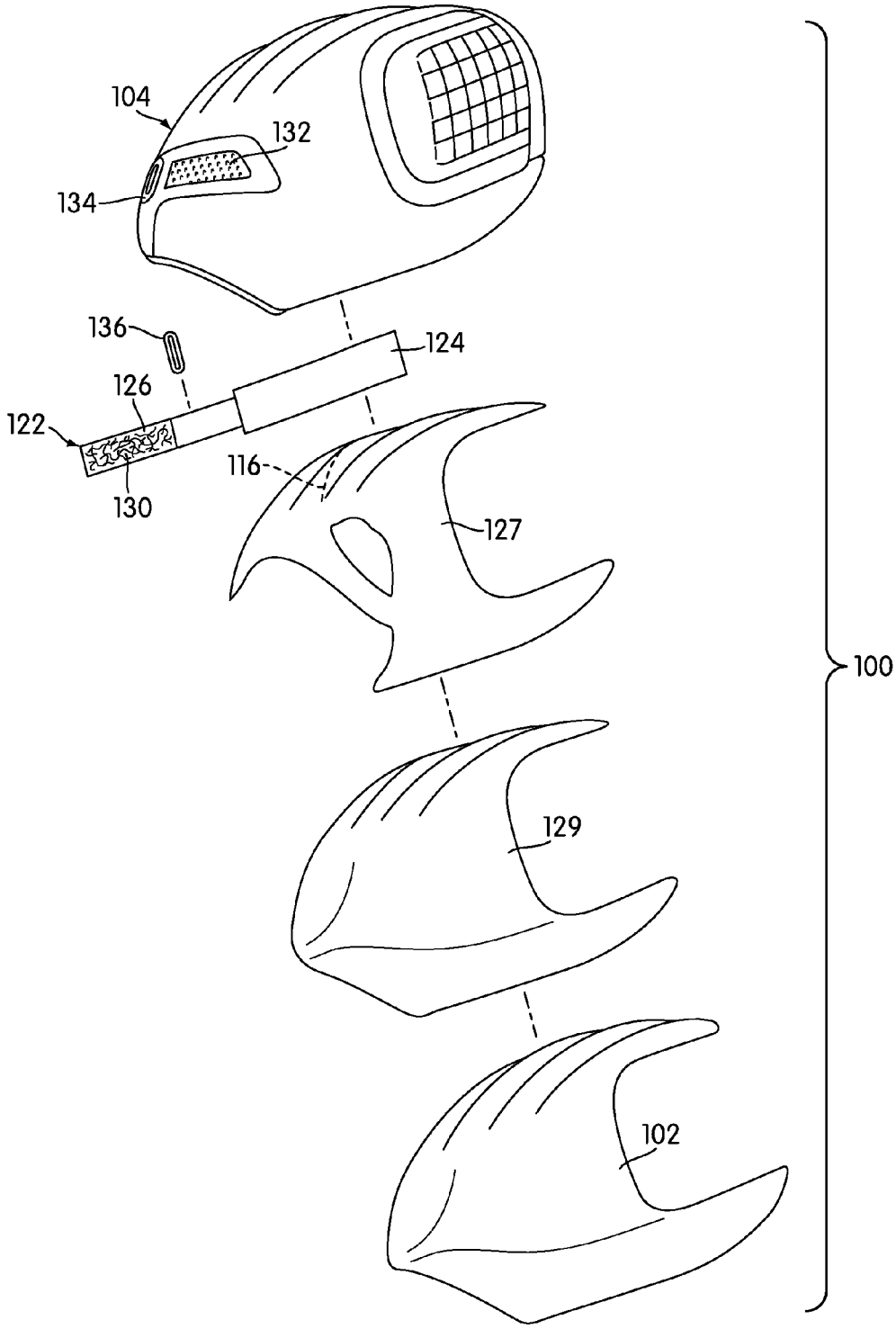
FIG. 3 is a schematic exploded view of the glove shown in FIG. 1.

As with conventional gloves, glove 100 includes padding to absorb and dissipate the impact of the ball when caught. As shown in FIG. 3, an outer padding layer 127 is fixedly attached to rear face 104 using conventional techniques, such as with an adhesive, stitching, such as around the perimeter, or the like. Similarly, a front padding layer 129 is fixedly attached to front face 102 using conventional techniques. Outer padding layer 127 preferably has a generally similar shape as rear face 104, and front padding layer 129 preferably has a generally similar shape as front face 102.

As shown in FIG. 2, glove 100 preferably includes a palm portion 111 with a thumb stall 106, a first finger stall 108, a second finger stall 110, a third finger stall 112, and a fourth finger stall 114 extending away from palm portion 111. As shown in FIG. 1, thumb stall 106 is sized and dimensioned to receive a thumb 115. First finger stall 108 is sized and dimensioned to receive the index or first finger 103. Second finger stall 110 is sized and dimensioned to receive the middle or third finger 105. In one embodiment, third finger stall 112 is sized and dimensioned to receive the ring or fourth finger 107, and fourth finger stall 114 is sized and dimensioned to receive the pinky or fifth finger 109.

To close glove 100 around a ball, all of the fingers and finger stalls are folded toward thumb stall 103. Fourth finger stall 114 forms the edge of glove 100, so fourth finger stall 114 is moved the furthest while closing glove 100. Therefore, in a preferred embodiment, third finger stall 112 and fourth finger stall 114 are connected to allow ring finger 107 and pinky 109 to occupy the same finger stall. As is known, ring finger 107 is the weakest of the fingers because it shares a flexor muscle with both middle finger 105 and pinky finger 109. By placing ring finger 107 and pinky finger 109 in the same finger stall, ring finger 107 and pinky finger 109 may move in unison to both compensate for the weakness of ring finger 107 in moving on its own and to provide additional power in moving fourth finger stall 114.

Preferably, third finger stall 112 and fourth finger stall 114 are configured to appear as conventional, separate finger stalls from the exterior. However, guide wall 116 is placed at or near the entrance to third finger stall 112. Guide wall 116 is preferably fixedly attached to both rear-side inner panel 127 and palm-side inner panel 129 in order to close off third finger stall 112. Additionally, guide wall 116 is preferably positioned at an angle so that when ring finger 107 is being inserted into glove 100 and encounters guide wall 116, ring finger 107 is pushed along guide wall 116 and directed into the correct position within fourth finger stall 114. Guide wall 116 is preferably made from leather or the same or similar material as that of rear-side inner panel 127.

In another embodiment, ring finger 107 may be inserted into the same finger stall as middle finger 105. In another embodiment, middle finger 105, ring finger 107, and pinky finger 109 may all be inserted into a single stall which is sized and dimensioned to accommodate all three fingers. In yet another embodiment, all four fingers may be inserted into a single stall.

A pocket 117 is preferably disposed between thumb stall 106 and first finger stall 108. Pocket 117 is a flap of material forming a web-like structure to prevent a ball being caught from readily slipping through the gap between thumb stall 106 and first finger stall 108. Pocket 117 is formed of material which is the same or similar to the material of rear face 104 and/or front face 102, such as leather. Pocket 117 is attached to thumb stall 106 and to first finger stall 108 using conventional methods, such as stitching or with an adhesive. Preferably, neither padding layer 127, 129 extends to pocket 117.

Pocket 117 may include an optional woven panel 118, although in other embodiments, pocket 117 may be solid or include slots. Woven panel 118 is preferably made by weaving strips of the material of pocket 117 to form the desired shape, then fixedly attaching woven panel 118 to a central portion of pocket 117, such as by stitching. Woven panel 118 increases the flexibility of pocket 117 by reducing the stiffness of the material of pocket 117. This allows hand 101 to open and close glove 100 more readily.

Strapping system 120 also enhances the natural ability of the hand to close or snap glove 100 around a ball. Strapping system 120 includes a compression strap 122. Compression strap 122 is preferably positioned over the main knuckles 113 of hand 101, the knuckles forming the joint between the fingers and the hand, to provide a compressive force onto knuckles 113. The force on knuckles 113 may be adjusted by increasing or decreasing the tension of compression strap 122. In other embodiments, compression strap 122 may be positioned over different part of hand 101 or the fingers. For example, in another embodiment, compression strap 122 may be positioned over the first finger joints of hand 101, the second finger joints of hand 101, or at any point along the fingers.

In one embodiment, as shown in FIGS. 1 and 3, compression strap 122 is preferably a strip of material that is attached to glove 100 so that compression strap 122 is divided into an inner portion 124 and an external or exposed portion 126. In one embodiment, compression strap 122 is made from multiple materials fixedly attached together. For example, a first type of material may be used for inner portion 124 and a second type of material for external portion 126 so that a more aesthetically pleasing or weatherproof material is used for the exposed external portion 126. In other embodiments, compression strap 122 may be made from a unitary piece of material. Compression strap 122 is preferably made from a non-elastic and durable material such as leather, though compression strap 122 may be made from other natural or synthetic materials, such as cotton, polyvinyl chloride, rubber, Spandex®, etc.

Inner portion 124 is fixedly connected to an inner portion of glove 100, preferably between outer padded layer 127 and rear face 104. Alternatively, inner portion 124 may be connected to glove 100 between outer padded layer 127 and inner padded layer 129, although care would need to be taken to ensure that hand 101 is inserted correctly into glove so hand 101 is inserted between inner portion 124 and inner padded layer 129.

Figure 4:
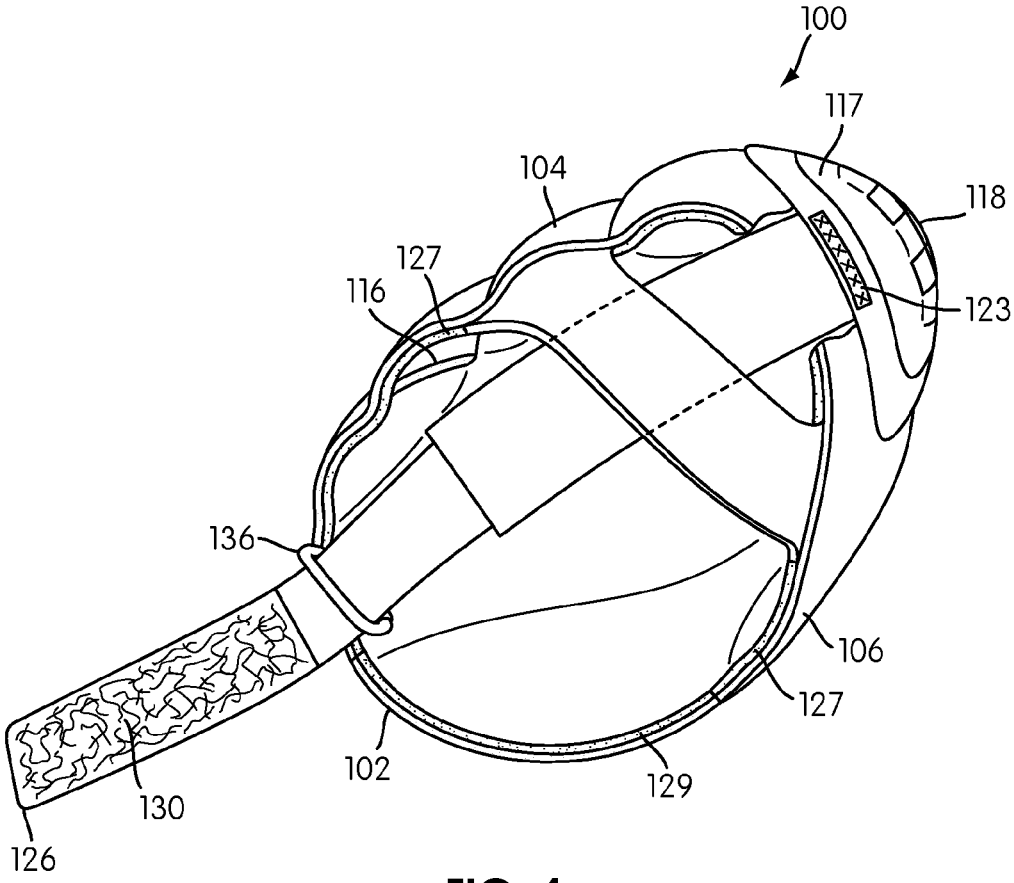
FIG. 4 is a schematic cut away bottom view of the glove shown in FIG. 1.

Inner portion 124 is preferably fixedly attached to glove 100 only at its end or edge, as shown in FIG. 4, although in other embodiments, inner portion 124 may be secured to glove 100 along a portion of or even its entire length. In the embodiment shown in FIG. 4, the end of inner portion 124 is stitched to glove 100 near pocket 117 with stitches 123. In other embodiments, other types of conventional attachment may be used, such as an adhesive.

Compression strap 122 is then threaded between outer pad layer 127 and rear face 104 to an aperture 134 formed in rear face 104. Aperture 134 is preferably an elongated hole extending through rear face 104. In other embodiments, such as where inner portion 124 of compression strap 122 is positioned between padded layers 127, 129, aperture 134 may extend through both rear face 104 and outer padded layer 127.

A ring 136 is optionally provided within aperture 134. Ring 136 is preferably rigid with a substantially similar shape as aperture 134, for example, an elongated oval or rectangle. Ring 136 is preferably made of a rigid material such as metal, plastic, or the like. Ring 136 is preferably fixedly attached to either or both of outer padded layer 127 and inner padded layer 129. Ring 136 may be attached by any conventional method, such as by stitching or with an adhesive. Compression strap 122 is preferably threaded through ring 136 and aperture 134 to stabilize and strengthen aperture 134. As compression strap 122 is pulled through aperture 134 to be attached to or detached from rear face 104 or is pulled tightly through aperture 134 and held in position, compression strap 122 pulls on and wears at aperture 134. Over time, aperture 134 may be deformed from its original size and shape or may even tear, thereby decreasing the ability of compression strap 122 to provide a sufficient level of force to knuckles 113. Ring 136 prevents this wear and tear, as ring 136 is less prone to being readily deformed.

Figure 5:
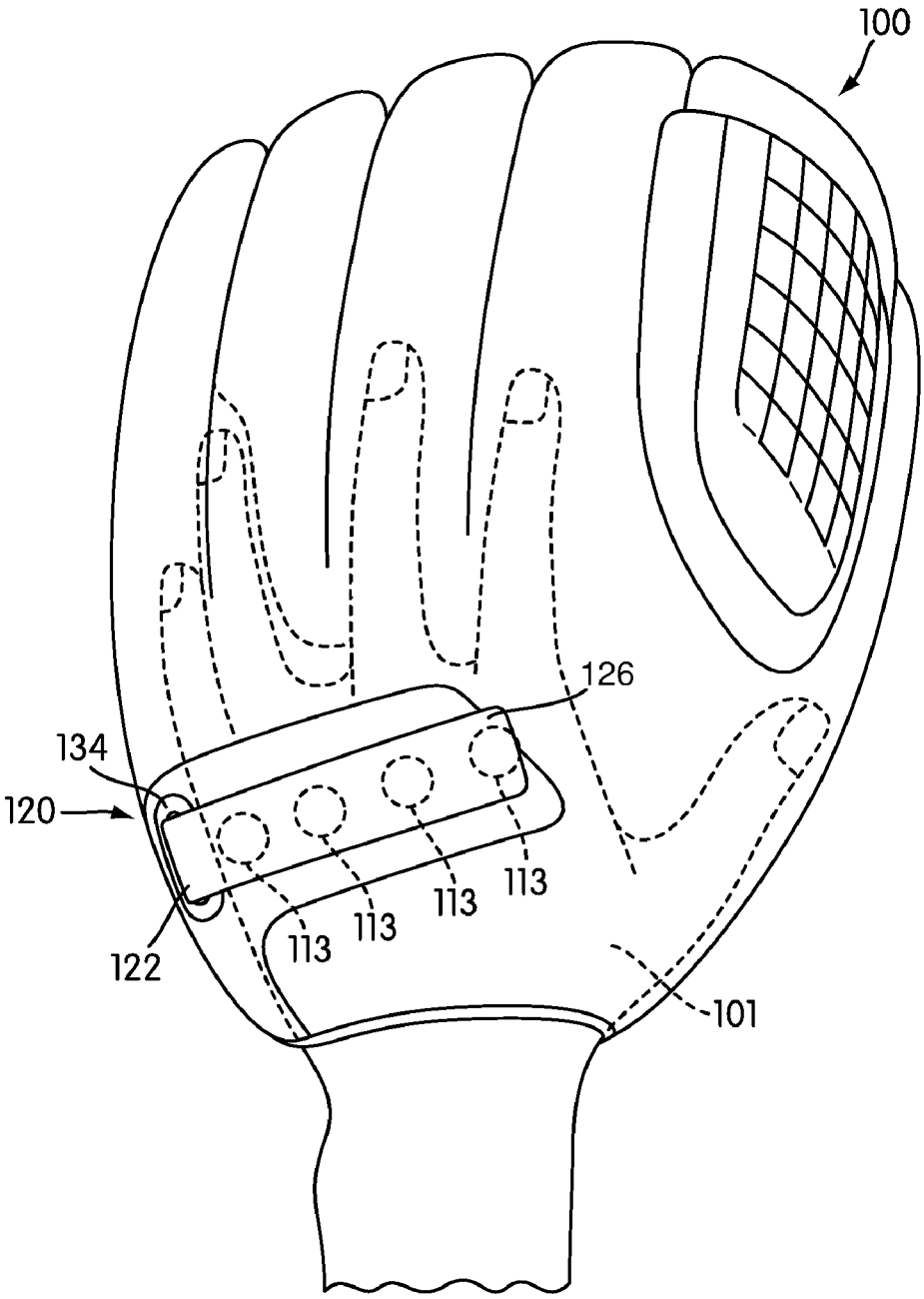
FIG. 5 is a rear view of the glove shown in FIG. 1 with the strapping system in a closed position.

Compression strap 122 passes through aperture 134 to expose external portion 126 of compression strap 122. As shown in FIG. 5, external portion 126 may be folded across rear face 104 toward pocket 117 and removably attached to rear face 104. External portion 126 of compression strap 122 is sized to be easily grasped by the user so that compression strap 122 is easily maneuvered using only one hand. In particular, the length of external portion 126 should be sufficiently long to provide such easy manipulation. Preferably, external portion 126 is long enough to extend at least half-way between aperture 134 and pocket 117. In other embodiments, external portion 126 may be long enough to extend less than half-way between aperture 134 and 117, to pocket 117, or beyond picket 117. It will be appreciated that the length of external portion 126 varies during normal use of glove 100. For example, when compression strap 122 is tightened, part of internal portion 124 may be pulled through aperture 134 to become part of external portion 126. Similarly, when compression strap 122 is loosened, part of external portion 126 may be drawn through aperture 134 to become part of internal portion 124. Preferably, the adjustment of the tension in compression strap 122 by pulling or loosening compression strap 122 only negligibly affects the fit of glove 100 on hand 101.

The side of external portion 126 of compression strap 122 opposite rear face 104 of glove 100 includes at least a portion of a securing mechanism. The securing mechanism may be any reusable conventional securing mechanism, such as snaps, button and buttonhole, buckle, or similar devices. However, the securing mechanism is preferably a hook and loop mechanism, such as Velcro®. A hook and loop mechanism makes securing external portion 126 to rear face 104 using only one hand simpler than trying to perfectly align and manipulate a snap, button, slide, or similar mechanism.

A first portion 130 of the securing mechanism is fixedly attached to external portion 126. Though shown in FIG. 1 as the loop portion, first portion 130 may be either the hook portion or the loop portion. A second portion 132 of the securing mechanism is fixedly attached to rear face 104 of glove 100. First portion 130 and second portion 132 may be attached using any conventional method, such as by sewing or using an adhesive.

Second portion 132 is positioned on rear face 104 so that first portion 130 is able to come into contact with and engage second portion 132 when external portion 126 has been folded across glove 100, as shown in FIG. 5. Once first portion 130 and second portion 132 are engaged, such as by being pressed together, external portion 126 is retained in position to maintain the desired tension of compression strap 122.

First portion 130 and second portion 132 are preferably similar in length to allow for a very secure connection of the two portions. However, in other embodiments, second portion 132 may be smaller than first portion 130 or larger than first portion 130. Also, second portion 132 is preferably co-extensive with first portion 130 when external portion 126 is attached to rear face 104, as shown in FIG. 5. However, in other embodiments, parts of second portion 132 may still show when external portion 126 is attached to rear face 104, for example, if a user desires that compression strap 122 provide only a small amount of force to knuckles 113. Similarly, compression strap 122 may be pulled very tightly to provide additional force to knuckles 113. In such a case, external portion 126 and first portion 130 of the securing mechanism may extend toward pocket 117 beyond the terminus of second portion 132.

FIGS. 1, 5, 6, and 7 show how strapping system 120 is used to enhance the ability of the hand to snap glove 100. In FIG. 1, hand 101 has just been inserted into glove 100. Compression strap 122 is in an open position so that first securing portion 130 of outer portion 126 is not attached to second securing portion 132 on rear face 104. At this point, no additional force is being applied to hand 101.

FIG. 5 shows glove 100 after first securing portion 130 has been removably attached to second securing portion 132. To do so, outer portion 126 of compression strap 122 is grasped by the non-gloved hand, in this case, the right hand (not shown). Compression strap 122 is pulled until the desired level of tension in compression strap 122 is achieved so that the desired level of pressure is applied to knuckles 113 of hand 101. During this pulling step, a segment of inner portion 124 may be pulled through aperture 134 in order to tighten compression strap 122 sufficiently. Outer portion 126 is then folded across rear face 104 toward thumb stall 106. First securing portion 130 is then engaged with second securing portion 132, such as by pressing the two portions together, to maintain the relative position of external portion 126 and rear face 104.

Figure 6:
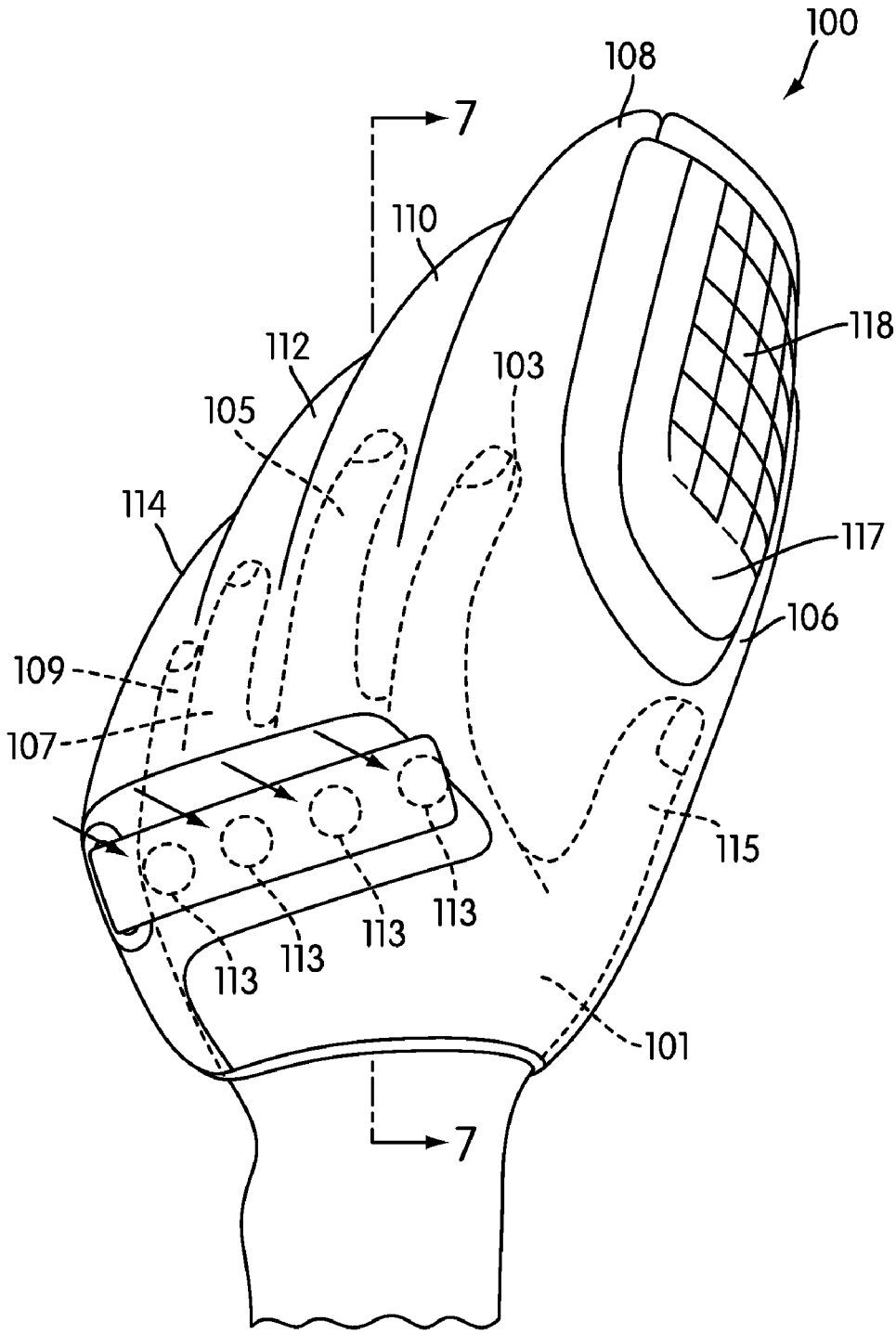
FIG. 6 is a schematic rear view of the glove shown in FIG. 1, with the glove closed, as around a ball.

FIG. 6 shows glove 100 as it is being snapped or closed. Finger stalls 108, 110, 112, 114 are being folded toward thumb stall 106 as fingers 103, 105, 107, 109 apply a force on finger stalls 108, 110, 112, 114 by bending fingers 103, 105, 107, 109 at knuckles 113. However, hand 101 may slip or wiggle within glove 100, wasting the force applied by the fingers and causing the fingers to expend additional energy to achieve the desired result. Over the course of play in a game, this wasted energy may contribute to early fatigue of hand 101. As indicated by the arrows, compression strap 122 applies a force in the same direction as the force applied by the fingers, i.e., toward thumb stall 106.

Figure 7:
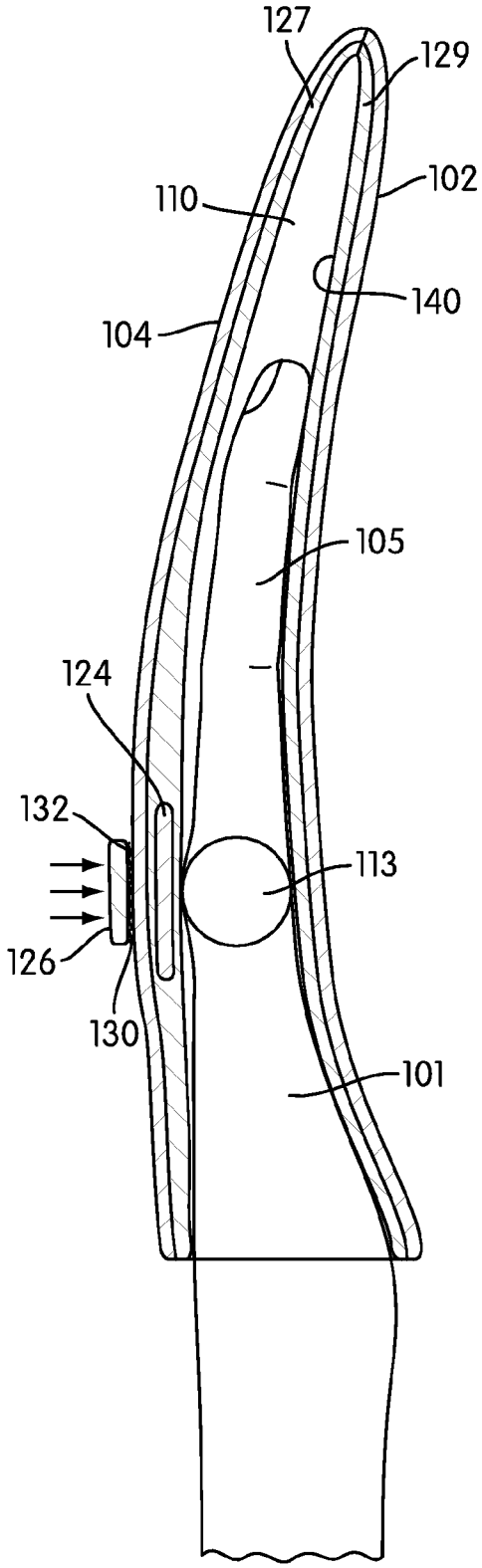
FIG. 7 is a schematic cross-sectional view of the glove of FIG. 6, taken along line 7-7.

As shown in FIG. 7, the force from compression strap 122 urges hand 101 toward an interior surface 140 of padded layer 129. In FIG. 7, only one finger 105 is shown for clarity, however, all fingers in glove 100 are positioned similarly. The force from compression strap 122 maintains the position of hand 101 against interior surface 140 to prevent slippage of finger 105 against that surface. Additionally, the force applied by compression strap 122 maintains the fingers in position with respect to each other, so that the ability of the fingers to wiggle and waste energy in inhibited. In a preferred embodiment, this compressive force is applied across knuckles. By preventing the loss of energy due to slippage of hand 101 and wiggling of the fingers, the ability of the athlete to snap glove 100 is increased.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A baseball or softball glove comprising:

a palm portion;

a thumb stall extending from the palm portion;

a first finger stall extending from the palm portion and spaced apart from the thumb stall;

a portion of material attached to the thumb stall and the first finger stall to form a pocket between the thumb stall and the first finger stall; and a compression strap including a first end and a second end, the first end being fixedly attached to the glove at the pocket, and the second end being removably attachable to an outer surface of a rear face of the palm portion, such that the compression strap provides a compressive force to at least one finger of a hand inserted into the glove.

2. The glove of claim 1, further comprising a second finger stall extending from the palm portion; and the second finger stall sized and dimensioned to receive at least two fingers.

3. The glove of claim 2, the second finger stall having an outward appearance of two separate finger stalls.

4. The glove of claim 3, the second finger stall having a guide wall formed near an entrance to the finger stall, the guide wall positioned to direct the two fingers into a portion of the second finger stall.

5. The glove of claim 4, the portion of the second finger stall being at or near the edge of the glove.

6. The glove of claim 1, a third finger stall extending away from the palm portion between the first finger stall and the second finger stall.

7. The glove of claim 1, the compressive force being applied to the main knuckles of the hand.

8. The glove of claim 1, the pocket including a woven portion.

9. The glove of claim 1, the first end of the compression strap being fixedly attached to the glove on an internal surface of the glove.

10. The glove of claim 9, the first end of the compression strap being sewn to the glove.

11. The glove of claim 9, the internal surface of the glove to which the first end of the compression strap is attached being between a padded layer and a rear face of the glove.

12. The glove of claim 9, a first portion of a securing mechanism being fixedly attached to the second end of the compression strap and a second portion of the securing mechanism being fixedly attached to an outer surface of the rear face of the glove.

13. The glove of claim 12, the securing mechanism comprising a hook-and-loop system.

14. The glove of claim 1, the first end of the compression strap being fixedly attached to an inner surface of the glove and the second end of the compression strap being threaded through an aperture formed in the rear face of the glove so that the second end of the compression strap may be attached to an outer surface of the rear face of the glove.

15. The glove of claim 14, a ring attached to the glove, the ring positioned within the aperture and the compression strap being threaded through the ring.

16. The glove of claim 15, the ring being made of a rigid material.

17. The glove of claim 14, further comprising a second finger stall located at the edge of the glove, wherein the aperture is located on the second finger stall.

18. A baseball or softball glove comprising:

a palm portion;

a first finger stall extending from the palm portion;

the first finger stall sized and dimensioned to receive at least two fingers; and a compression strap removably attachable to an outer surface of a rear face of the palm portion to provide a compressive force to a hand inserted into the glove, the compression strap being located between the first finger stall and a wrist portion of the glove, further comprising a thumb stall extending from the palm portion; a second finger stall extending from the palm portion and spaced apart from the thumb stall; and a portion of material attached to the thumb stall and the second finger stall to form a pocket between the thumb stall and the second finger stall, and wherein the compression strap includes a first end and a second end, and the first end is fixedly attached to the glove at the pocket.

19. The glove of claim 18, the compressive force being applied to the main knuckles of the hand.

20. The glove of claim 18, wherein the first finger stall is located at the edge of the glove, and the compression strap includes a first end and a second end, the first end being fixedly attached to the glove and the second end of the compression strap being threaded through an aperture, the aperture being formed in the rear face of the glove and being located on the second finger stall.

* * * * *